US007458525B2

(12) United States Patent
Matsumoto

(10) Patent No.: US 7,458,525 B2
(45) Date of Patent: Dec. 2, 2008

(54) COMMON-RAIL INJECTOR

(75) Inventor: Shuichi Matsumoto, Kariya (JP)

(73) Assignee: Denso Corporation (JP)

( * ) Notice: Subject to any disclaimer, the term of this patent is extended or adjusted under 35 U.S.C. 154(b) by 286 days.

(21) Appl. No.: 11/175,023

(22) Filed: Jul. 6, 2005

(65) Prior Publication Data

US 2006/0016906 A1 Jan. 26, 2006

(30) Foreign Application Priority Data

Jul. 6, 2004 (JP) ..... 2004-198866
May 31, 2005 (JP) ..... 2005-158576

(51) Int. Cl.
*B05B 1/08* (2006.01)

(52) U.S. Cl. ..... 239/102.2; 239/96; 239/124; 239/584; 123/498

(58) Field of Classification Search ..... 239/102.1, 239/96, 102.2, 124, 584, 585.1; 123/496, 123/498
See application file for complete search history.

(56) References Cited

U.S. PATENT DOCUMENTS

| | | | | |
|---|---|---|---|---|
| 6,062,489 | A * | 5/2000 | Tokumaru | 239/124 |
| 6,168,087 | B1 | 1/2001 | Cooke | |
| 6,196,193 | B1 | 3/2001 | Heinz et al. | |
| 6,367,453 | B1 * | 4/2002 | Igashira et al. | 239/96 |
| 6,471,142 | B1 * | 10/2002 | Lambert | 239/96 |
| 6,729,554 | B2 * | 5/2004 | Katsura et al. | 239/96 |
| 2002/0117560 | A1 * | 8/2002 | Igashira et al. | 239/585.1 |

FOREIGN PATENT DOCUMENTS

| | | |
|---|---|---|
| EP | 1241346 A | 9/2002 |
| EP | 1433952 A | 6/2004 |
| JP | 2001-41125 | 2/2001 |
| JP | 2001-140726 | 5/2001 |
| JP | 2002-227747 | 8/2002 |
| WO | WO 01/81754 A | 11/2001 |
| WO | WO 02/14682 A | 2/2002 |
| WO | WO 03/004861 | 1/2003 |
| WO | WO 03/012322 A | 2/2003 |
| WO | WO 2004/051071 A | 6/2004 |

OTHER PUBLICATIONS

Chinese Office Action dated Aug. 31, 2007 issued in corresponding Chinese Application No. 2005100818938 with English translation.

(Continued)

*Primary Examiner*—Steven J Ganey
(74) *Attorney, Agent, or Firm*—Nixon & Vanderhye PC

(57) ABSTRACT

A common rail injector for injecting fuel through a high-pressure channel includes a control chamber, a control valve, and a drive unit. The control chamber applies pressure to a nozzle needle. The control valve switches communication of the control chamber between the high-pressure channel and a low-pressure channel. The drive unit selectively sets a valve element of the control valve on a low-pressure side seat or a high-pressure side seat. The drive unit has an actuator and a slide pin member. The slide pin member slides inside a slide hole to transmit a force to the valve element. A diameter of the low-pressure side seat is less than or equal to a diameter of the high-pressure side seat. The pressure in the control chamber is exerted as an assistance force, so that a high-pressure side seat closing load becomes less than or equal to a low-pressure side seat opening load.

19 Claims, 7 Drawing Sheets

OTHER PUBLICATIONS

European Search Report—Sep. 14, 2005.
Chinese Office Action dated May 7, 2008 issued in Chinese Application No. 2005 100818938 with English translation.
Chinese Office Action dated Apr. 4, 2008 issued in Chinese Application No. 2005 100818938 with English translation.

* cited by examiner

COMMON-RAIL INJECTOR

CROSS REFERENCE TO RELATED APPLICATIONS

This application is based upon and claims the benefit of priority of Japanese Patent Application No. 2004-198866, filed on Jul. 6, 2004 and Japanese Patent Application No. 2005-158576, filed on May 31, 2005, the contents of which are incorporated herein by reference.

FIELD OF THE INVENTION

The present invention relates to a common-rail injector for a diesel engine and, more particularly, to an injector in which a control chamber pressure for moving a nozzle needle up and down is controlled with a three-way valve.

BACKGROUND

In a diesel engine, a common-rail type fuel injection system has been known in which a common rail common to each cylinder is provided to accumulate high-pressure fuel. High-pressure fuel is force fed from a fuel supply pump to the common rail and controlled to a predetermined pressure. Injectors of the respective cylinders are then driven at predetermined timing to inject the fuel. A common-rail injector typically has a control chamber for applying a pressure in a valve-closing direction to a nozzle needle, and a control valve for controlling the pressure of the control chamber. The injector is configured so that an actuator drives the control valve to increase and decrease the pressure of the control chamber.

For the control valve, a three-way valve structure for selectively making the control chamber communicate with a high-pressure channel or a low-pressure channel is suitably used. The valve element of the three-way valve is arranged in a valve chamber provided with a low-pressure side seat leading to the low-pressure channel and a high-pressure side seat leading to the high-pressure channel. The valve element moves between the two seats to switch the seat position. With the three-way valve structure, the valve element sits on the high-pressure side seat to interrupt the communication with the high-pressure channel during fuel injection, whereby the high-pressure fuel is prevented from flowing out through the valve chamber. For example, a piezo actuator is used as the actuator. When electrically energized, the piezo actuator extends to release the valve element from the low-pressure side seat, and then sets it on the high-pressure side seat. Since the piezo actuator has excellent response, sophisticated fuel injection control is expected.

Control valves having a three-way valve structure are described, for example, in (1) Japanese Patent Laid-Open Publication No. 2000-130614; (2) Japanese Patent Laid-Open Publication No. 2002-227747; (3) Japanese Patent Laid-Open Publication No. 2001-41125; (4) Japanese PCT National Publication No. 2001-500218; and (5) Japanese Patent Laid-Open Publication No. 2001-140726. The first four patent documents listed above include a throttle disposed on the downstream side of the low-pressure side seat. This configuration advantageously suppresses the nozzle opening speed to improve controllability of the amount of injection.

Also, for the sake of operating the common-rail type fuel injection system efficiently, it is desirable to reduce fuel leakage as much as possible. Nevertheless, the first two patent documents listed above deal with a pressure balance valve, which constantly causes leakage through its sliding portion.

In this case, extra work is required of the pump, and that leakage increases the fuel temperature and deteriorates the fuel. The control valve of the third patent document listed above has a spherical valve element, and in order to accommodate this, its high-pressure side seat member and low-pressure side seat member are formed as separate members. In this case, leakage can occur due to positional shifts of the two members. This is described in the second and fifth patent documents listed above. Therefore, this is difficult to use when the amount of lift is small.

The fifth patent document listed above proposes that a plurality of valve members capable of relative movement be arranged so as to allow proper operation even with positional shifts. However, this configuration gets very complicated. Moreover, for improved controllability on the amount of injection, it is desirable to increase the nozzle closing speed. In general, the opening area of the high-pressure side seat can be increased to increase the nozzle closing speed. Nevertheless, since the piezo actuator has the characteristic that the displacement and the produced force are inversely proportional to each other, the increased opening area of the high-pressure side seat makes the closing driving force greater, thereby causing the problem of reduced energy efficiency.

SUMMARY

An embodiment of the present invention reduces a driving force necessary for closing a high-pressure side seat of an injector for use in a common-rail type fuel injection system of a diesel engine or the like, and suppress fuel leakage from the control valve to decrease a nozzle opening speed or increase a nozzle closing speed with a simple configuration, thereby enhancing the energy efficiency and allowing high-precision control of the amount of injection.

In one aspect of the present invention, an injector includes a control valve of three-way valve structure for increasing and decreasing a pressure of a control chamber that generates a nozzle back pressure. A drive unit thereof is composed of an actuator and a slide pin member. The slide pin member has a pin-shaped extremity in contact with a valve element of the control valve accommodated in a valve chamber. The slide pin member slides inside a slide hole in accordance with a displacement of the actuator, thereby selectively setting it on a low-pressure side seat or a high-pressure side seat. A space formed around the pin-shaped extremity, between a sliding portion of the slide pin member and the low-pressure side seat, is connected to a low-pressure channel through a throttle portion. When the low-pressure side seat diameter is less than or equal to the high-pressure side seat diameter, the pressure of the control chamber in communication with the valve chamber is exerted as an assistance force so that a high-pressure side seat closing load becomes less than or equal to the opening load of the low-pressure side seat.

According to the foregoing configuration, the throttle portion set to the space formed around the extremity of the slide pin member can decrease the nozzle opening speed at the time of opening of the low-pressure side seat. Moreover, the pressure of the control chamber can be exerted in the closing direction of the high-pressure side seat, thereby reducing the driving force for closing the high-pressure side seat. Consequently, it is possible to increase the high-pressure side seat diameter for a higher nozzle closing speed, and improve the injection controllability and energy efficiency with a simple configuration.

According to another aspect of the present invention, a slide diameter of the slide hole and seat diameters of the low-pressure side seat and the high-pressure side seat have the following relationship: the slide diameter is less than or equal to the low-pressure side seat diameter; and the low-pressure side seat diameter is less than or equal to the high-pressure side seat diameter. The slide diameter can be decreased to reduce the driving force necessary to open and close, or close in particular, the high-pressure side seat.

According to still another aspect of the present invention, a space formed around the pin-shaped extremity, between a sliding portion of the slide pin member and the low-pressure side seat, is connected to the low-pressure channel through a throttle portion. Additionally, a slide diameter of the sliding portion and a seat diameter of the high-pressure side seat have the following relationship: the slide diameter is less than or equal to the high-pressure side seat diameter. This enables the pressure of the control chamber in communication with the valve chamber to be exerted as an assistance force.

According to the foregoing configuration, the throttle portion set to the space formed around the extremity of the slide pin member can decrease the nozzle opening speed at the time of opening of the low-pressure side seat. Moreover, the pressure of the control chamber can be exerted in the closing direction of the high-pressure side seat, thereby reducing the driving force for closing the high-pressure side seat. Furthermore, the slide diameter can be reduced to decrease the driving force necessary for closing the high-pressure side seat. Consequently, it is possible to increase the high-pressure side seat diameter for a higher nozzle closing speed, and improve the injection controllability and energy efficiency with a simple configuration.

According to still another aspect of the present invention, the pressure of the control chamber in communication with the valve chamber is exerted as an assistance force so that a high-pressure side seat closing load becomes less than or equal to a low-pressure side seat opening load.

The control chamber pressure can be suitably adjusted so that the high-pressure side seat closing load becomes less than or equal to the low-pressure side seat opening load, with a further improvement in the energy efficiency.

According to still another aspect of the present invention, the actuator is a piezo actuator. Since an embodiment of the present invention includes the piezo actuator, which has the relationship that the produced force decreases with an increasing displacement, it is possible to utilize the characteristic effectively.

According to still another aspect of the present invention, the pressure of the control chamber possible for the nozzle needle to be opened at is set to or above 50% of a supply fuel pressure when under a maximum load or maximum pressure. This makes the high-pressure side seat closing load smaller than the opening load of the low-pressure side seat, thereby allowing efficient control on the amount of injection.

According to still another aspect of the present invention, the slide pin member and the valve element are formed separately. This facilitates machining the seat portions.

According to still yet another aspect of the present invention, both ends of the slide pin member are shaped like a pin having a diameter smaller than the slide diameter. This can preclude malfunction due to assembly errors.

According to still yet another aspect of the present invention, the slide pin member may be formed as a circular cylindrical pin having a constant diameter over its entire length thereof. In that case, the end of the slide hole leading to the low-pressure side seat is provided with an expanded portion having a greater diameter, the extremity of the slide pin member is located therein, and the throttle portion is formed so as to open to this expanded portion. This simplifies the configuration of the slide pin member for easy machining.

According to still yet another aspect of the present invention, the valve element has a generally hemispherical shape. The contact surface against the slide pin member provides the effect of avoiding uneven contact and relaxing Hertz stress when it is machined into a spherical surface having a curvature greater than that of a sphere.

According to still yet another aspect of the present invention, at least a sliding surface of the slide pin member is made of a superhard material or a ceramic. This can improve the slidability and reduce or prevent wear.

According to still yet another aspect of the present invention, the slide pin member is made of a superhard material having a Young's modulus higher than that of metal. This provides the effect of reducing or preventng deformation loss.

According to still yet another aspect of the present invention, a valve spring for biasing the valve element toward the low-pressure side seat is arranged on the upstream side of the high-pressure side seat. It is therefore possible to reduce the valve chamber volume for higher response.

According to still yet another aspect of the present invention, the individual components are configured so as to satisfy the following expression:

$$kpo = 1 - \frac{Ds^2}{Dc^2} - \frac{Fk}{Pc \cdot \frac{\pi}{4} \cdot Dc^2} \geq 0.5 (\text{when } Pc = Pc \text{ max})$$

wherein kpo is a control chamber pressure ratio at the time of nozzle opening, Ds is a diameter of a nozzle seat for the nozzle needle to sit on, Dc is a control chamber slide diameter, Fk is a nozzle set load, and Pc is a fuel supply pressure from the common rail when Pc=Pcmax, which is a maximum supply pressure.

Consequently, the foregoing effect of reducing the high-pressure side seat opening load and reducing the driving force for closing the high-pressure side seat is obtained easily.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

Figure 1:
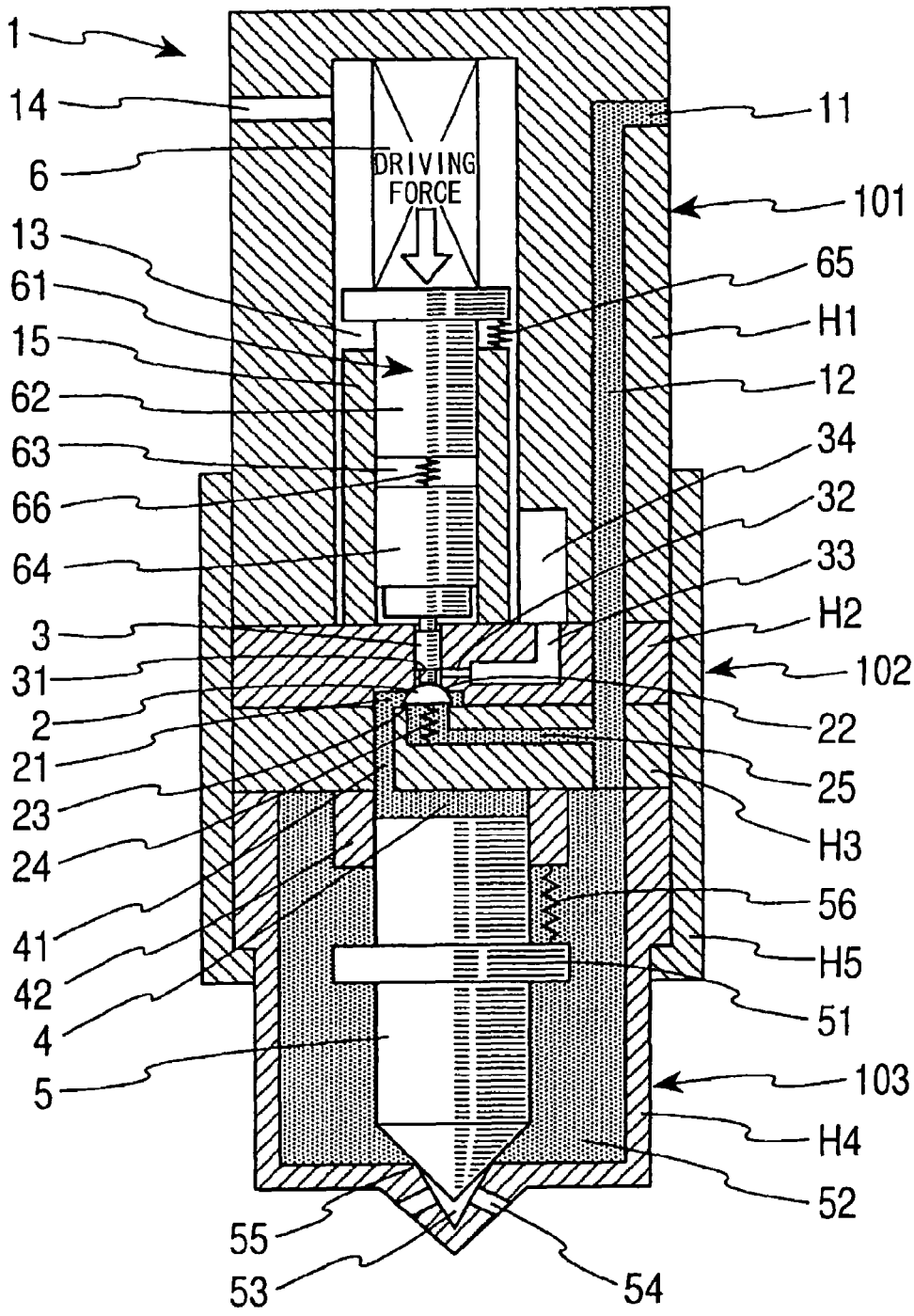
FIG. 1 is a cross-sectional view of an injector according to a first embodiment of the present invention.

Hereinafter, the present invention will be described with reference to the drawings. FIG. 1 is a cross-sectional view of an injector 1 according a first embodiment, which will be described as an example of applying the first embodiment of the present invention to a common-rail type fuel injection system of a diesel engine. The injector 1 is arranged corresponding to each cylinder of the engine (here, only one of them is shown), and receives fuel supply from a common rail. The fuel, which is to be force fed by a high-pressure supply pump, is accumulated in the common rail at a predetermined high pressure corresponding to an injection pressure.

In FIG. 1, the upper half of the injector 1 is a drive unit 101 having a piezo actuator 6. A control valve unit 102 having a three-way valve structure is used to drive a nozzle unit 103 having a nozzle needle 5 for fuel injection. The injector 1 is attached to a not-shown combustion chamber wall (not shown). Channels such as a high-pressure channel 12 communicating with the common rail (not shown) through a fuel inlet 11 and a low-pressure channel 13 communicating with a fuel tank (not shown) through a fuel outlet 14 are formed inside housing members H1 to H4, which accommodate the components of the foregoing individual units 101 to 103. The housing members H1 to H4 are fastened and fixed oiltightly by a retainer H5.

In the nozzle unit 103, the nozzle needle 5 having a flange 51 on its periphery is slidably retained in a tubular part 42 which is arranged on the top end of the housing member H1. The space inside the housing member H4 forms an oil reservoir chamber 52, which is supplied with a high-pressure fuel from the common rail through the high-pressure channel 12 which opens in the upper wall of the same. A sack part 53 is formed on the bottom of the housing member H4. An injection hole 54 is formed through the wall that forms the sack part 53.

When the nozzle needle 5 is in its bottom position, its cone-shaped extremity sits on a nozzle seat 55 formed at the interface between the oil reservoir chamber 52 and the sack part 53, thereby closing the sack part 53 to interrupt the fuel supply from the oil reservoir chamber 52 to the injection hole 54. When the nozzle needle 5 is lifted and released from the nozzle seat 55 to open the sack part 53, the fuel is injected.

A space defined by a top end of the nozzle needle 5, the inner wall surface of the tubular part 42, and a bottom end of the housing member H3 makes a control chamber 4 for controlling a nozzle back pressure. Fuel, or a control oil, is introduced into the control chamber 4 from the high-pressure channel 12 through a valve chamber 21 and a channel 25 of the control valve unit 102, thereby generating the back pressure of the nozzle needle 5. This back pressure acts on the nozzle needle 5 downward, and biases the nozzle needle 5 in the closing direction along with a spring 56 which is held between the flange 51 and the bottom end of the tubular part 42. Meanwhile, the high-pressure fuel in the oil reservoir chamber 52 acts on the conical surface of the extremity of the nozzle needle 5 upward, and biases the nozzle needle 5 in the opening direction.

The control valve unit 102 of three-way valve structure has the valve chamber 21 which is always in communication with the control chamber 4 of the nozzle unit 103 through a communicating channel 41, and a valve element 2 of generally spherical shape, which is accommodated in the valve chamber 21. The opening formed in the top side of the valve chamber 21 is provided with a low-pressure side seat 22, and the opening in the bottom side is provided with a high-pressure side seat 23, 50 that the valve element 2 sits on either one of these seats 22 and 23 selectively. A throttle portion 32 for setting the nozzle opening speed is formed on the downstream side of the low-pressure side seat 22, and is put in communication with the low-pressure channel 13 through channels 33 and 34. As illustrated, the throttle portion 32 has a passage cross-sectional area smaller than a passage cross-sectional area of the a portion of an adjacent channel 33 on a low-pressure channel side of the throttle portion that has a longitudinal axis generally parallel to a longitudinal axis of the throttle portion 32. The channel 25 formed on the upstream side of the high-pressure side seat 23 is in communication with the high-pressure channel 12. The valve element 2 is driven to move up and down by pressure from the drive unit 101, whereby the seat position of the valve element 2 is switched. It follows that the valve chamber 21 communicates with the high-pressure channel 12 or the low-pressure channel 13, thereby increasing or decreasing the pressure of the control chamber 4 in communication with the valve chamber 21, which is the back pressure acting on the nozzle needle 5.

The valve element 2 is made of a single member, and the valve chamber 21 is formed by butt joining the two housing members H2 and H3. The throttle portion 32 and the channel 33 are formed in the housing member H2, and the communicating channel 41 and the channel 25 are formed in the housing member H3. In the present embodiment, no throttle narrower than the opening area of the low-pressure side seat 22 is formed between the control chamber 4 and the valve chamber 21. The reason is that the nozzle closing speed might be reduced by the provision of a throttle here. A throttle for setting the nozzle closing speed may be or may not be formed on the upstream side of the high-pressure side seat 23, whereas it is not formed in the present embodiment. The configuration of the valve element 2, the low-pressure side seat 22, and the high-pressure side seat 23 will be detailed later.

A valve spring 24 is arranged in the end of the channel 25 on the side of the valve chamber 21, and biases the valve element 2 upward in the figure. When the high-pressure supply pump starts pressurization at the time of engine startup, the valve element 2 must be biased toward the low-pressure side seat 22 for the sake of quick pressurization. If the valve spring 24 for that purpose is arranged inside the valve chamber 21, however, the volume of the valve chamber 21 and the volume of the control chamber 4 increases with a drop in response. Thus, the valve spring 24 is arranged on the upstream side of the high-pressure side seat 22 as in the present embodiment, but it should be understood that the presenting invention is not limited to such a configuration.

The drive unit 101 transmits the driving force of the piezo actuator 6, serving as the actuator, to the valve element 2 of the control valve unit 102 by using a hydraulic transmission system 61 and a slide pin member 3. The piezo actuator 6 is accommodated in the top end of a longitudinal hole formed in the housing member H1, and the hydraulic transmission system 61 is accommodated in the bottom end of the longitudinal hole. The piezo actuator 6 has a piezostack in which piezoelectric ceramic layers such as PZT and electrode layers are laminated alternately, and is configured to be charged and discharged by a not-shown drive circuit with the direction of lamination (the vertical direction) as the direction of expansion and contraction. The space inside the longitudinal hole defines the low-pressure channel 13. The channel 34 formed aside below is connected with the channel 33 in the housing member H2.

The hydraulic transmission system 61 comprises a first piston 62 and a second piston 64, which have the same diameter and are slidably arranged in the tubular cylinder member 15, and an oiltight chamber 63, which is formed between the two pistons and filled with a hydraulic oil. The first piston 62 has a top end of large diameter, protruding above the cylinder member 15 into contact with the bottom end of the piezo actuator 6. A piezo spring 65 arranged between the large-diameter top end and the top side of the cylinder member 15 applies a certain initial load to the piezo actuator 6 through the first piston 62. Consequently, the first piston 62 keeps in contact with the piezo actuator 6 while integrally moving up and down with the expansion and contraction of the same.

A valve spring 66 is arranged in the oiltight chamber 63, biasing the second piston 64 downward. The bottom end of the second piston 64 is in contact with the slide pin member 3. The slide pin member 3 is arranged so as to be slidable in a slide hole 31, which is formed in the housing member H2. The lower end thereof is in contact with the valve element 2 in the valve chamber 21. The slide hole 31 is formed so as to make the longitudinal hole in the housing member H1 and the valve chamber 21 communicate with each other. Consequently, when the piezo actuator 6 expands to press the first piston 62 downward, the pressing force is hydraulically converted in the oiltight chamber 63 and transmitted to the second piston 64. The second piston 64 drives the valve element 2 through the slide pin member 3. The slide pin member 3 is shaped like a pin so that both ends thereof have a diameter smaller than a slide diameter in its mid-region. One of the ends is in contact with the bottom end of the second piston 64, and the other with the top end of the valve element 2.

Figure 2A:
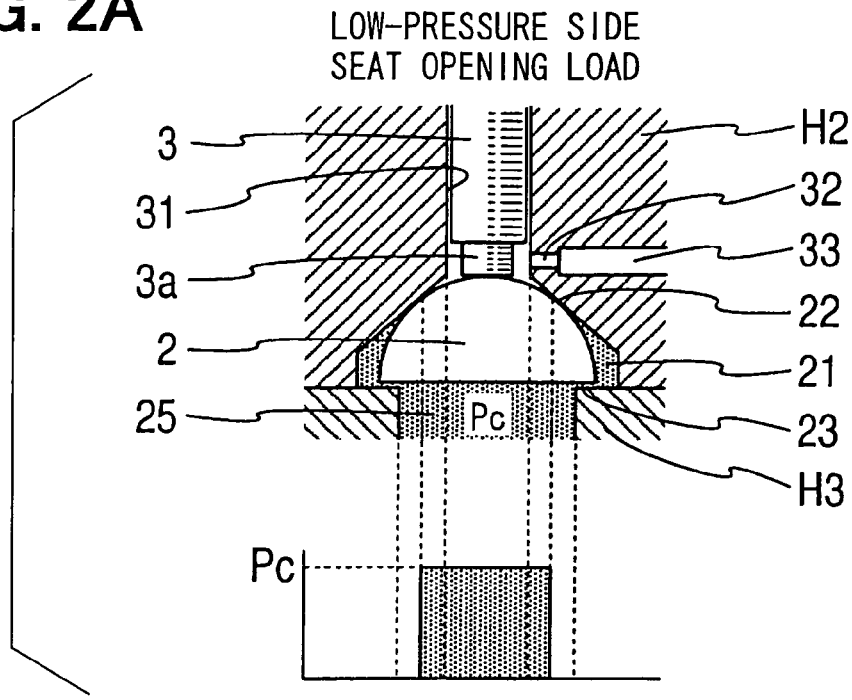
FIG. 2A is a detailed cross-sectional view of a low-pressure side seat according to the first embodiment of the present invention in an opened condition.

As shown in FIG. 2A, an annular space is formed in the slide hole 31 around the pin-shaped extremity 3*a* on the side of the valve element 2, between the sliding portion of the slide pin member 3 and the low-pressure side seat 22. The throttle portion 32 opens in the side wall of the slide hole 31 to face this annular space. In one embodiment, the slide pin member 3 only has the smaller diameter portion at the extremity 3*a*. This makes it possible to reduce the low-pressure side seat diameter (given a constant slide diameter), and reduce the driving force for opening the low-pressure side seat. The valve element 2 is substantially hemispherical with a fiat face and a spherical surface, and is arranged in the valve chamber 21 with the spherical surface disposed upward in the figure. A contact surface of the valve element 2 contacting the slide pin member 3 is machined into the spherical surface having a curvature greater than the original curvature of the valve element 2. This aims to avoid uneven contact of the slide pin member 3 and to relax Hertz stress. In the valve chamber 21, the top side, in which the slide hole 31 opens toward, is provided with the low-pressure side seat 22 having the shape of a conical surface for the spherical surface of the valve element 2 to contact. The bottom, in which the channel 25 opens, is provided with the high-pressure side seat 23 having the shape of a horizontal surface for the flat surface of the valve element 2 to make contact with.

As described above, when one of the seat portions is formed as a flat seat, it becomes less likely for the valve element 2 and the low-pressure side or high-pressure side seat 22 or 23 to cause a seating failure therebetween even if the housing members H2 and H3 constituting the valve chamber 2 shift in position. It is therefore possible to reduce or prevent leakage and facilitate machining. Moreover, considering the sticking (biting) of foreign matters to the seat portions, the smooth spherical-conical surface seat is more prone to sticking than a flat seat having corners. If the high-pressure side seat portion attracts foreign matter and causes a seating failure, the amount of injection tends to decrease. If the low-pressure side seat portion attracts foreign matter with a delay in closing the valve, on the other hand, the delayed nozzle closing timing can cause an increase in the amount of injection. To avoid this, the low-pressure side seat portion is desirably shaped as a smooth spherical-conical surface.

For the purpose of avoiding wear and securing slidability, the slide pin member 3 is preferably configured so that at least the sliding surface is made of a superhard material or a ceramic. However, it should be appreciated that alternative materials may also be used. Moreover, for the sake of avoiding deformation loss, it is preferable to use members having a high Young's modulus like a superhard material. However, it should be appreciated that alternative materials may also be used. Furthermore, while the slide pin member 3 and the valve element 2 in the present embodiment are formed as separate members, these may be combined into a single member in an alternative embodiment. Forming separate members facilitates machining the low-pressure side seat portion of the valve element 2. As described above, in order to form the annular space in the slide hole 31, the slide pin member 3 has only to be formed in the pin shape of smaller diameter near the valve element 2. Nevertheless, both the ends are preferably given the same pin shape as in the present embodiment. This can eliminate the distinction between the top and the bottom, thereby facilitating assembly.

Figure 3:
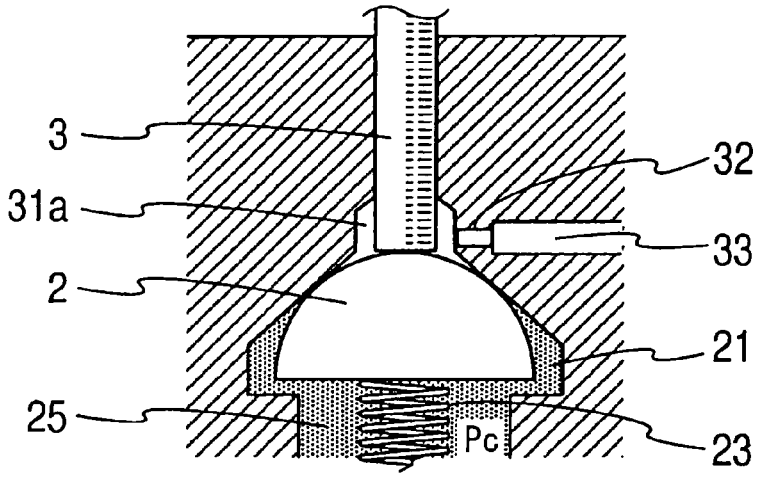
FIG. 3 is a detailed cross-sectional view of an alternative example of a slide pin member according to the first embodiment of the present invention.

Otherwise, as in FIG. 3, the slide pin member 3 may be a circular cylindrical pin having the same diameter over the entire length thereof. In this case, the end of the slide hole 31 where the extremity makes contact with the valve element 2, between the sliding portion and the low-pressure side seat 22, may be formed as an expanded portion 31*a* greater than the slide diameter so that the throttle portion 32 is formed in this expanded portion 31*a*. This simplifies the shape of the slide pin member 3 and facilitates machining thereof. This is particularly advantageous when the slide pin member 3 is made of a hard-to-machine material such as a superhard material.

In the present invention, the relationship between the seat diameters of the low-pressure side seat 22 and the high-pressure side seat 23 is such that the low-pressure side seat 22 has a diameter that is less than or equal to a diameter of the high-pressure side seat 22, and preferably the low-pressure side seat diameter is less than the high-pressure side seat diameter. When the opening area of the high-pressure side seat is rendered greater than the opening area of the low-pressure side seat, it is possible to increase the pressure of the control chamber 4 at the time of closing of the nozzle quickly, thereby increasing the nozzle closing speed. Consequently, when the valve element 2 is machined out of a spherical member, the seat plane to be formed on the valve element 2 is formed near the center of the sphere. If the seat plane is off the sphere center, and a low-pressure side seat diameter smaller than the high-pressure side seat diameter is desired, the vertex angle of the conical surface of the housing member H2, serving as the low-pressure side seat 22, approaches 180° with a deterioration in seat stability. The relationship of the slide diameter of the slide pin member 3 with the seat diameters of the low-pressure side seat 22 and the high-pressure side seat 23 is such that the slide diameter is less than or equal to the low-pressure side seat diameter, which is less than or equal to the high-pressure side seat diameter. The slide diameter can be reduced to decrease the driving force necessary to open and close, or close in particular, the high-pressure side seat.

The low-pressure side seat 22 preferably has a smaller seat diameter so that the low-pressure side seat opening load can be reduced. When the low-pressure side seat 22 is closed, as shown in FIG. 2A, the interior of the valve chamber 21 is high in pressure (common-rail supply pressure Pc) and this supply pressure Pc acts on the opening area of the low-pressure side seat upward. Consequently, the seat diameter of the low-pressure side seat 22 can be reduced to decrease the low-pressure side seat opening load, thereby reducing the driving force necessary for opening.

Figure 2B:
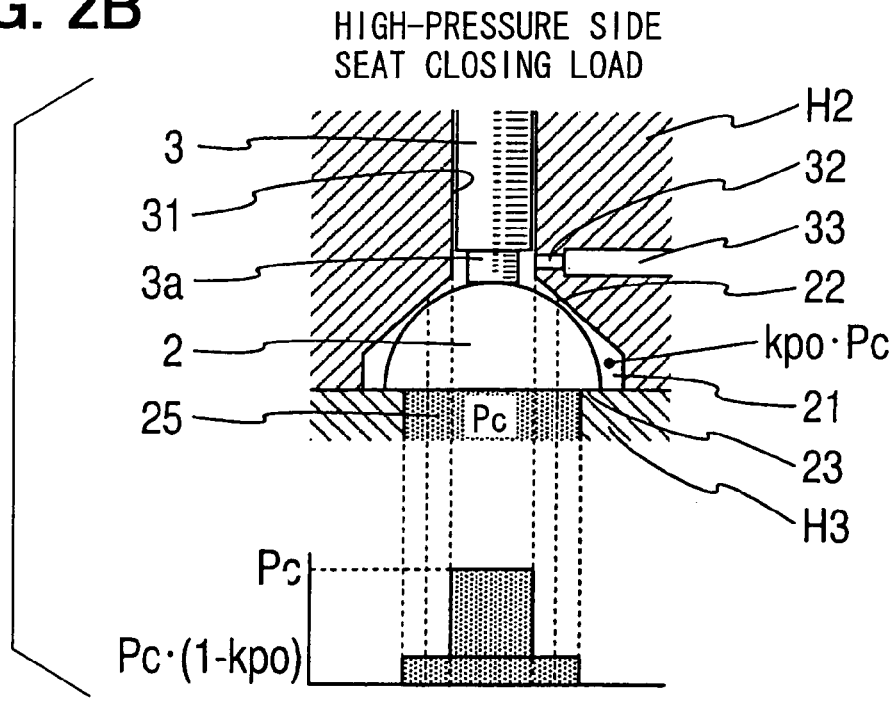
FIG. 2B is a detailed cross-sectional view of a high-pressure side seat according to the first embodiment of the present invention in a closed condition.

Furthermore, in order to secure the force for closing the high-pressure side seat 23, which has the greater seat diameter, the fuel pressure in the valve chamber 21 is utilized as an assist pressure at the time of closing of the high-pressure side seat 23. This can make the high-pressure side closing driving force smaller than a value of the opening area of the high-pressure side seat multiplied by the supply pressure. As shown in FIG. 2B, with the configuration that the throttle portion 32 lies on the downstream side of the low-pressure side seat 22, the pressure of the valve chamber 21 at the time opening of the low-pressure side seat, i.e., the pressure of the control chamber 4, becomes higher than that of the low-pressure channel 13. Then, this pressure is maintained as high as possible while the nozzle needle 5 can be opened so that the high-pressure side seat closing load is reduced as much as possible. In terms of a control chamber pressure ratio kpo at the time of opening of the nozzle (the ratio of the pressure of the control chamber 4 possible for the nozzle needle 5 to be opened at the supply pressure), the pressure of the valve chamber 21 is expressed as kpo·Pc. Then, the pressure Pc·(1−kpo), obtained by subtracting this pressure kpo·Pc from the supply pressure Pc, acts on the opening area of the high-pressure side seat and the opening area of the low-pressure side seat in an upward direction in the figure.

Figure 4:
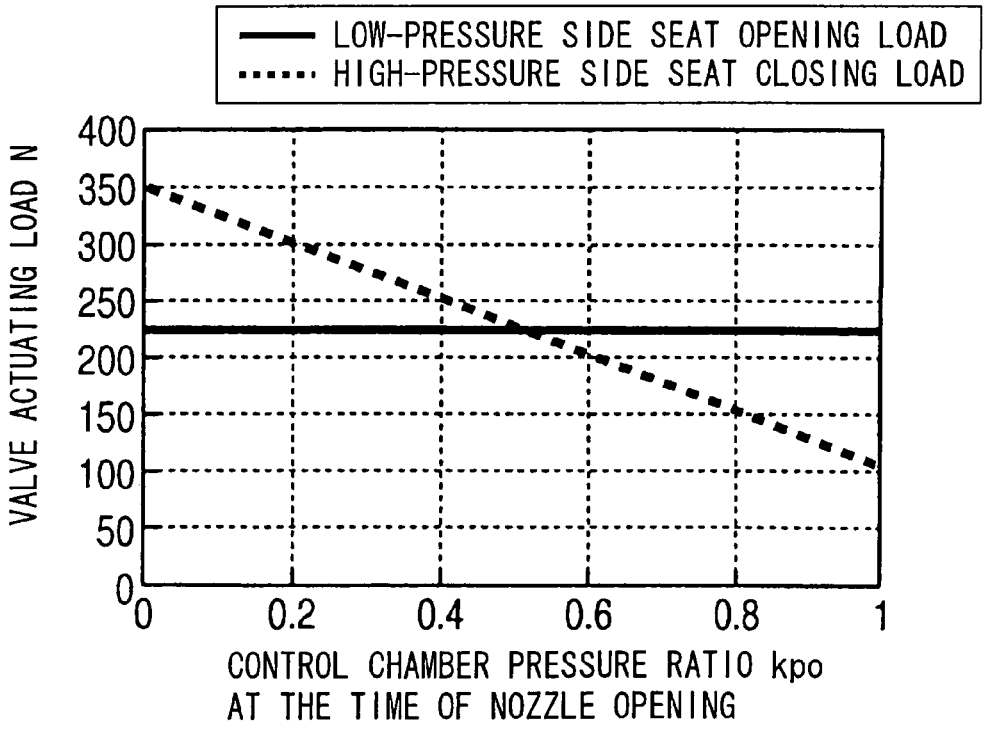
FIG. 4 is a graph showing a relationship between a control chamber pressure ratio at the time of opening of a nozzle with the low-pressure side seat opening load and the high-pressure side seat closing load according to the first embodiment of the present invention.

Specifically, during ordinary use, the nozzle needle 5 will not be fully lifted into contact with the stopper, which is the top end of the control chamber. Various settings are determined so that the pressure of the control chamber 4 will not fall to or below half the supply pressure Pc at least in the domain where the supply pressure Pc is greater than or equal to half the maximum supply pressure Pcmax. The control chamber pressure ratio kpo is suitably set so that the high-pressure side seat opening load is less than or equal to the low-pressure side seat opening load. For a typical example, FIG. 4 shows the relationship of the control chamber pressure ratio kpo at the time of opening of the nozzle with the low-pressure side seat opening load and the high-pressure side seal closing load for situations where the slide diameter of the slide pin member 3=ϕ0.8, the low-pressure side seat diameter=ϕ1.2, the high-pressure side seat diameter=ϕ1.5, and the maximum supply pressure is 200 MPa. From this chart, it can be seen that the higher the control chamber pressure ratio kpo expressed by the following expression is, the smaller the high-pressure side seat closing load becomes, and that control chamber pressure ratios kpo of approximately 0.5 and above can make the high-pressure side seat closing load smaller than the low-pressure side seat opening load.

$$kpo = 1 - \frac{Ds^2}{Dc^2} - \frac{Fk}{Pc \cdot \frac{\pi}{4} \cdot Dc^2} \geq 0.5 \quad \text{[exp. 3]}$$

(when $Pc = Pc$ max)

| |
|---|
| *kpo*: the control chamber pressure ratio at the time of opening of the nozzle |
| *Ds*: nozzle seat diameter |
| *Dc*: control chamber slide diameter |
| *Fk*: nozzle set load |
| *Pc*: supply pressure |

In general, an output characteristic of the piezo actuator 6 is such that the produced force decreases with an increasing piezo displacement. Since the produced force decreases near the high-pressure side seat 23 where the displacement is large, securing the force for closing the high-pressure side seat 23 with large seat diameters can increase the driving energy. When the piezo actuator 6, which produces smaller force with an increasing displacement is used, the configuration of the present invention can thus be adopted to utilize the fuel pressure in the valve chamber 21 as the assistsnce force, so that the high-pressure side seat closing load is reduced. Specifically, the nozzle seat diameter, the nozzle slide diameter, and the nozzle seat load are determined, so as to satisfy the foregoing expression.

Next, description will be given of the injector 1 having the foregoing configuration. FIG. 2A shows the state where the piezo actuator 6 of FIG. 1 is discharged for contraction. The valve member 2 lies in its top position for closing the low-pressure side seat 22, so that the communication of the throttle portion 32 and the channel 33, leading to the low-pressure channel 13, with the valve chamber 2 is interrupted. The valve chamber 2 is high in pressure due to the fuel that flows in from the high-pressure channel 12 through the channel 25 and the high-pressure side seat 23. Here, the control chamber 4 in communication with the valve chamber 2 through the communicating channel 41 also becomes high in pressure. The pressure of this control chamber 4 and the biasing force of the spring 56 set the nozzle needle 5 on the nozzle seat 55, so that no fuel is injected.

When the piezo actuator 6 is energized from this state, the piezo actuator 6 expands. The first piston 62 moves downward accordingly and compresses the hydraulic oil (here, light oil) in the oiltight chamber 63. When the pressure of this hydraulic oil moves the second piston 64 downward and the slide pin member 3 pushes down the valve element 2, the valve element 2 leaves the low-pressure side seat 22 and moves further downward to sit on the high-pressure side seat 23. Consequently, the control chamber 4 communicates with the low-pressure channel 13 through the valve chamber 21, the low-pressure side seat 22, the throttle portion 32, and the channel 33. When the pressure of the control chamber 4 drops and the downward biasing force of the nozzle needle 5 falls below the upward biasing force, the nozzle needle 5 leaves the seat to start fuel injection. Here, since the control chamber 4 has the throttle portion 32 on the downstream side of the low-pressure side seat 22, it causes a mild drop in pressure and the nozzle opening speed decreases.

In addition, the pressure kpo·Pc of the valve chamber 21 acts as an assistance force in the direction for closing the high-pressure side seat 23. This makes the high-pressure side seat closing load less than or equal to the low-pressure side seat opening load, thereby allowing a reduction in the high-pressure side closing driving force. Consequently, it is possible to utilize the output characteristic of the piezo actuator 6 efficiently.

When the piezo actuator 6 is discharged again for contraction, the first piston 62 moves upward. The pressure of the oiltight chamber 63 decreases to release the force for pressing down the valve element 2. Consequently, the valve element 2 sits on the low-pressure side seat 22 to cut off the control chamber 4 and the low-pressure channel 13 from each other. The pressure of the control chamber 4 increases again due to the high-pressure fuel flowing in through the channel 25, and the needle 3 sits on the seat to end the injection. Here, since the low-pressure side seat diameter is less than or equal to the high-pressure side seat diameter, the pressure of the control chamber 4 rises quickly for a higher nozzle closing speed.

Figure 5A:
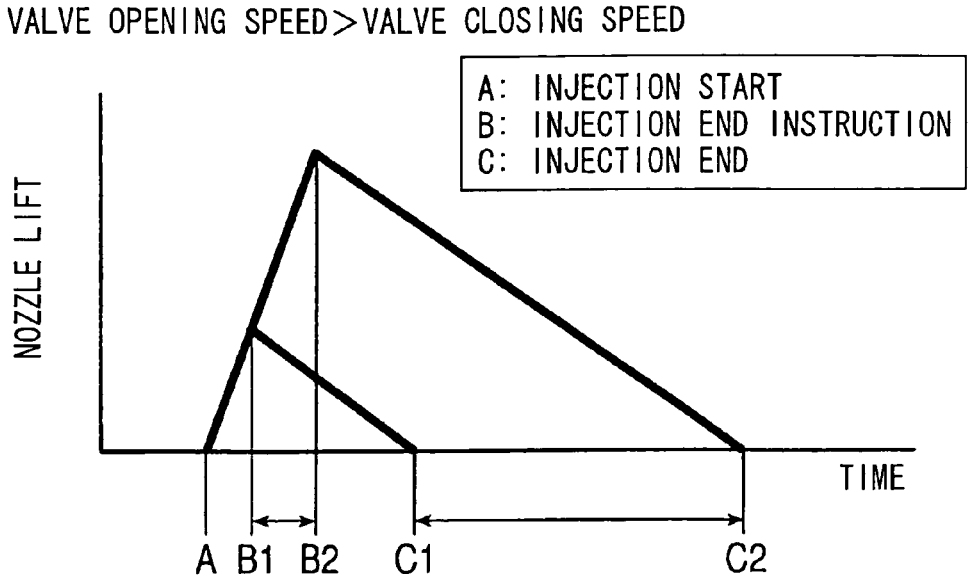
FIG. 5A is a graph showing a case where a valve opening speed is greater than a valve closing speed according to an embodiment of the present invention.
Figure 5B:
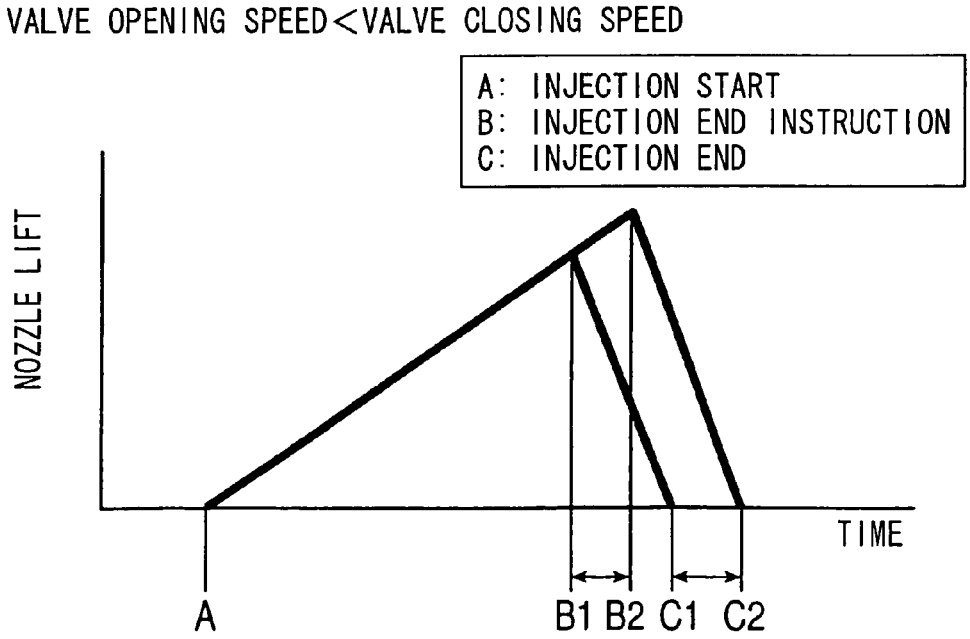
FIG. 5B is a graph showing a case where a valve opening speed is less than a valve closing speed according to an embodiment of the present invention.

FIG. 5 is a graph for showing the relationship of the nozzle opening speed and the nozzle closing speed with the controllability of the amount of injection. FIG. 5A shows the case where the nozzle opening speed is greater than the nozzle closing speed, and FIG. 5B shows the case where the nozzle opening speed is less than the nozzle closing speed. For the sake of an identical rectangular injection level, the sum of the nozzle opening speed and the nozzle closing speed shall be a constant. In FIGS. 5A and 5B, if the injection end instruction timing varies between B1 and B2 due to variations in the drive pulse end timing including noise effects, variations in piezo contraction, and the like, then the injection end timing varies between C1 and C2. It can be seen here that when the nozzle opening speed is lower and the nozzle closing speed is higher, as shown in FIG. 5B, variations in the injection end timing and variations in the amount of injection decrease with an improvement to the controllability on the amount of injection.

Figure 6:
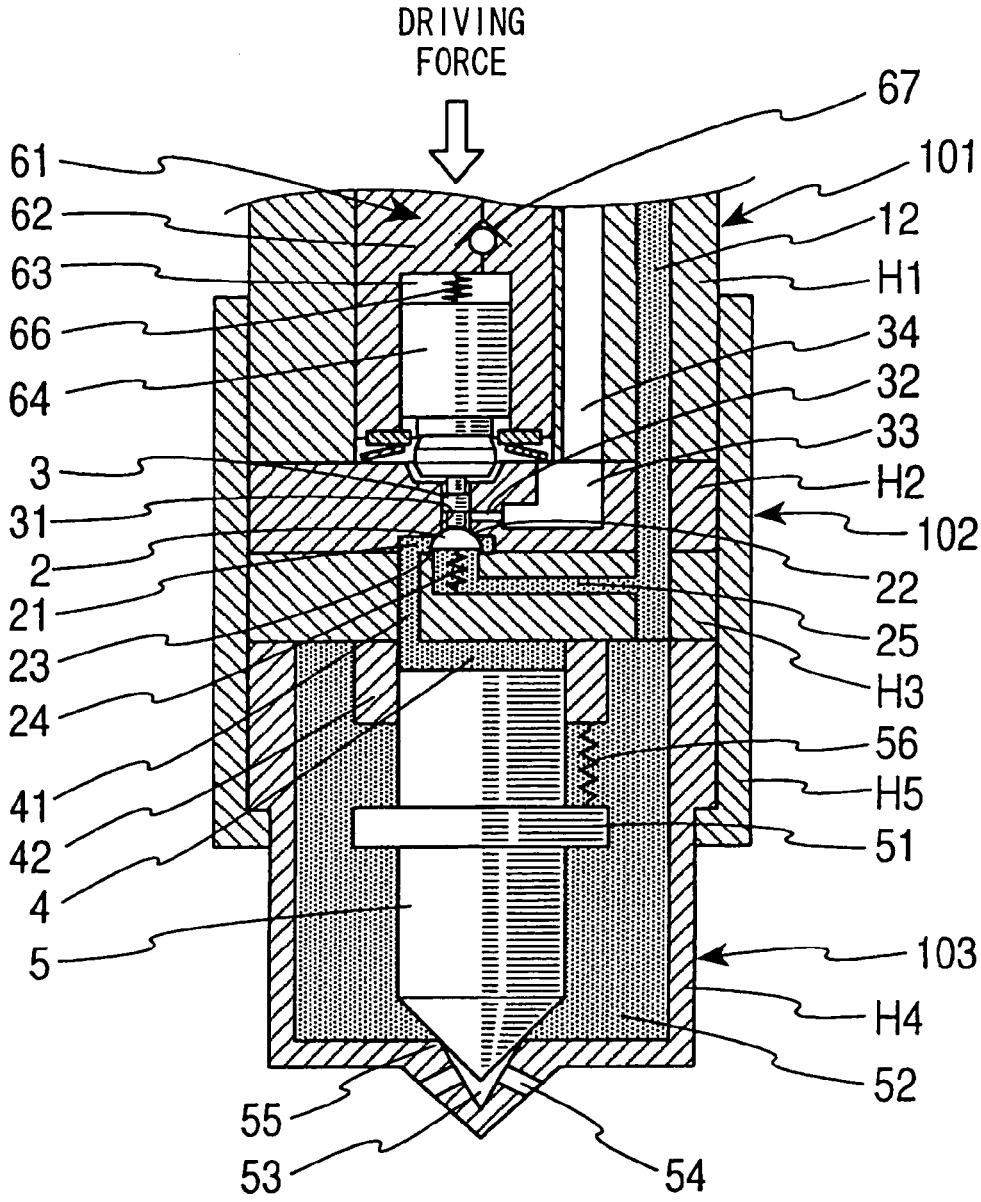
FIG. 6 is a partial cross-sectional view of an injector according to a second embodiment of the present invention.

FIG. 6 shows a second embodiment of the present invention including another example of a configuration of the hydraulic transmission system in the piezo drive unit 101. The general configuration and the basic operation of the injector 1 are the same as in the foregoing first embodiment. Description thereof will thus be omitted. As shown in FIG. 6, according to the present embodiment, a first piston 62 having the shape of a tube with a closed top is slidably arranged in a tubular cylinder. A second piston 64 having a smaller diameter is slidably arranged in the first piston 62. An oiltight chamber 63 filled with a hydraulic oil is formed in the space defined between the first piston 62 and the second piston 64. The first piston 62 is biased upward by a piezo spring 66 disposed below the first piston 62, and a slide pin member 3 is put in contact with the bottom end of the second piston 64, which protrudes downward from inside the tube of the first piston 62. A check valve 67 is formed in the upper wall of the first piston 62 so as to establish communication between the oiltight chamber 63 and a low-pressure part. When the pressure of the oiltight chamber 63 drops due to leakage, the fuel presses down the ball valve and flows in from the low-pressure part. The oiltight chamber 63 can thus be refilled with the fuel.

The present embodiment can also provide the same effects as in each of the foregoing embodiments. Moreover, in the present embodiment, the second piston 64 is accommodated in the first piston 62. This configuration reduces the axial length of the hydraulic transmission system 61. The entire injector thus becomes compact.

Figure 7:
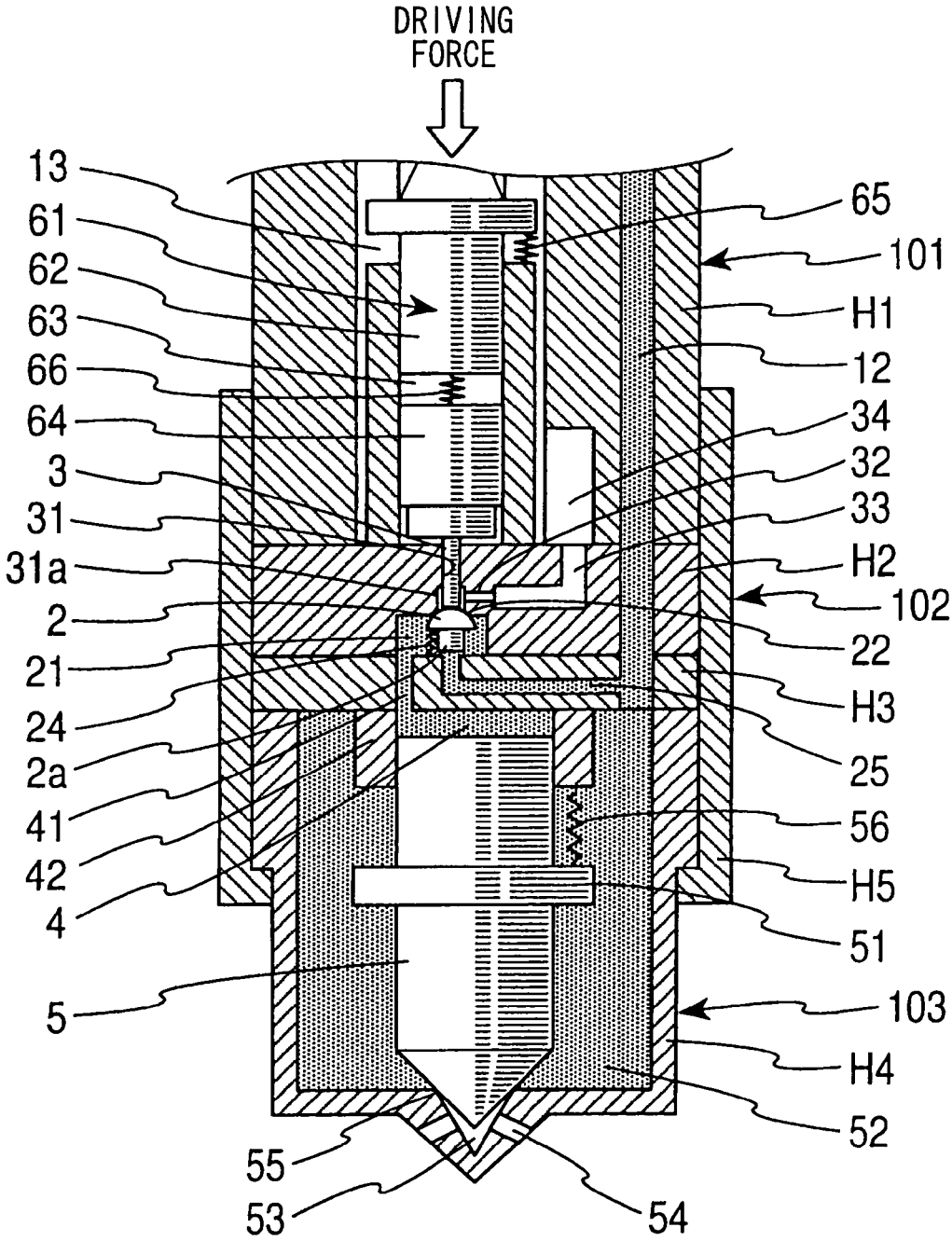
FIG. 7 is a partial cross-sectional view of an injector according to a third embodiment of the present invention.
Figure 8:
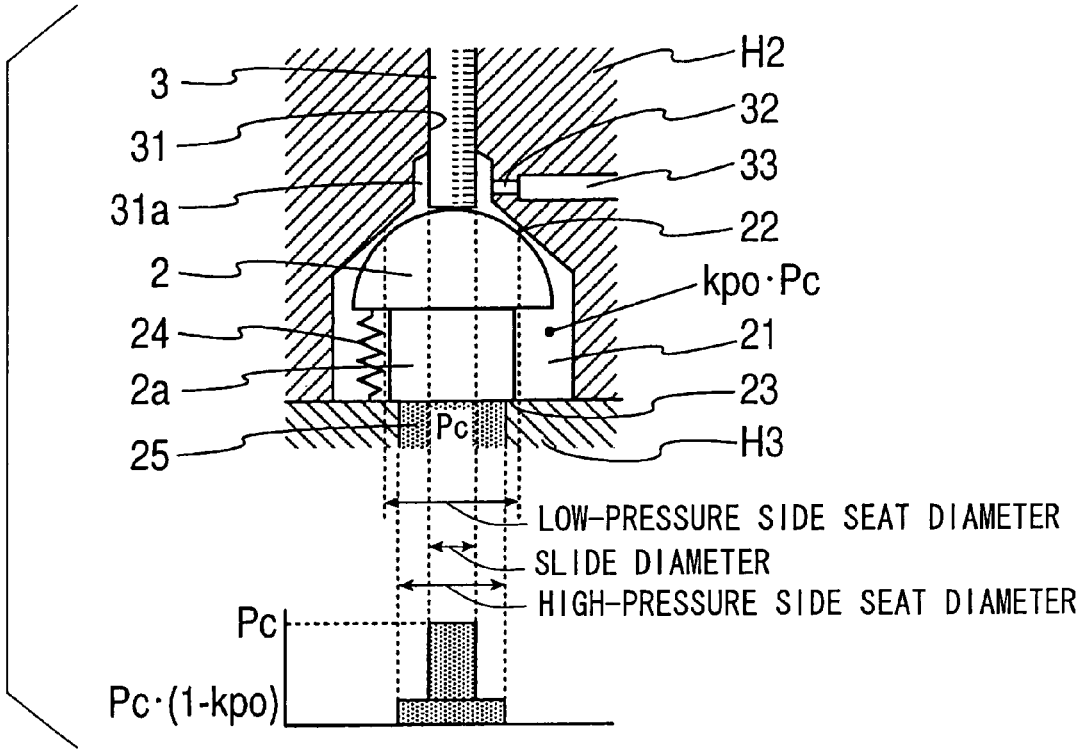
FIG. 8 is a detailed cross-sectional view of a valve element of the injector of FIG. 7.

FIGS. 7 and 8 show a third embodiment of the present invention, or another example of the configuration of the control valve unit 102. The general configuration and the basic operation of the injector 1 are the same as in the foregoing first embodiment. Description thereof will thus be omitted. As shown in FIGS. 7 and 8, according to the present embodiment, the valve element 2 is shaped like a mushroom which consists of an upper half of generally hemispherical shape and a lower half of columnar shape, having a smaller outer diameter. The slide pin member 3 is a circular cylindrical pin which has an identical diameter over the entire length thereof. The end of a slide hole 31 where the extremity of the pin lies is formed as an expanded portion 3*a* having a diameter greater than the slide diameter, and a throttle portion 32 is opened there. A valve spring 24 is arranged in the valve chamber 21, and is supported between the bottom of the same and the underside of the upper half of the valve element 2 which spreads out like a flange.

In the configuration of the present embodiment, the high-pressure side seat diameter can be made smaller since the valve spring 24 is not arranged in the upstream channel of the high-pressure side seat 23. This makes it possible to reduce the driving force necessary for closing the high-pressure side seat 23. Besides, as in the foregoing embodiments, the slide diameter is made smaller than or equal to the high-pressure side seat diameter, so that the closing load of the high-pressure side seat 23 can be further reduced to improve the energy efficiency. Moreover, in the present embodiment, the high-pressure side seat diameter is made smaller than or equal to the low-pressure side seat diameter. In the foregoing embodiments, the high-pressure side seat diameter is increased for the sake of increasing the nozzle closing speed, whereas this is not restrictive. As in the present embodiment, the high-pressure side seat diameter may be made smaller than or equal to the low-pressure side seat diameter, thereby allowing effective use of the output characteristic of the piezo actuator 6 which produces higher force near the low-pressure side seat 22.

Furthermore, as shown in FIG. 7, according to the present embodiment, the communicating channel 41 between the control chamber 4 and the valve chamber 21 is formed as a throttle which has an opening area smaller than that of the low-pressure side seat 22. This can suppress pressure variations of the control chamber 4, thereby suppressing vibrations at the time of opening of the nozzle needle 5.

As in the foregoing embodiments, when the piezo actuator 6 is used as the actuator, displacements are extremely small. Thus, the hydraulic transmission system 61 having the first piston 62 of large diameter and the second piston 64 of small diameter in combination may also be used. In this case, the displacements can be magnified for transmission, which allows more efficient power transmission.

The actuator may use any device as long as it causes a displacement when electrically energized. Aside from the piezo device used in each of the foregoing embodiments, a magnetostrictor or the like may also be used.

What is claimed is:

1. A common rail injector for injecting fuel supplied from a common rail through a high-pressure channel, comprising:

a control chamber for applying a pressure in a valve-closing direction to a nozzle needle;

a control valve having a three-way valve structure for switching between communication and interruption of said control chamber with said high-pressure channel and a low-pressure channel, thereby increasing and decreasing the pressure of said control chamber; and a drive unit for driving a valve element of said control valve to selectively set the valve element on a low-pressure side seat, which communicates between said control chamber and said low-pressure channel, or a high-pressure side seat, which communicates between said control chamber and said high-pressure channel, wherein said drive unit has an actuator for causing a displacement when electrically energized, and a slide pin member for sliding inside a slide hole to transmit a driving force in accordance with the displacement of said actuator, said slide pin member having a pin-shaped extremity in contact with said valve element of said control valve accommodated in a valve chamber, a space formed around said pin-shaped extremity disposed between a sliding portion of said slide pin member and said low-pressure side seat is always communicated with said low-pressure channel through a throttle portion, which has a passage cross-sectional area smaller than a passage cross-sectional area of a portion of an adjacent channel that is located adjacent to said throttle portion on a low-pressure channel side of said throttle portion, and has a longitudinal axis generally parallel to a longitudinal axis of the throttle portion, to communicate between said throttle portion and said low-pressure channel, a diameter of an opening, which is surrounded by said low-pressure seat and is communicated with said low-pressure channel, is less than or equal to a diameter of an opening, which is surrounded by said high-pressure seat and is communicated with said high-pressure channel, and the pressure in said control chamber in communication with said valve chamber is exerted as an assistance force, so that a high-pressure side seat closing load becomes less than or equal to a low-pressure side seat opening load.

2. The common rail injector according to claim 1, wherein a slide diameter of said slide hole is less than or equal to said diameter of said low-pressure side seat, and said diameter of said low-pressure side seat is less than or equal to said diameter of said high-pressure side seat.

3. The common rail injector according to claim 1, wherein said actuator is a piezo actuator.

4. The common rail injector according to claim 1, wherein the pressure in the control chamber possible for the nozzle needle to be opened at is at least 50% a supply fuel pressure when under a maximum load of the valve drive and a maximum fuel pressure from a common rail.

5. The common rail injector according to claim 1, wherein said slide pin member and said valve element are formed separately.

6. The common rail injector according to claim 1, wherein;

said pin-shaped extremity of said slide pin member is a first pin-shaped extremity provided at a first end of said slide pin member;

said slide pin member also has a second pin-shaped extremity at a second end of said slide pin member; and each of said first and second pin-shaped extremities has a corresponding diameter smaller than the slide diameter.

7. The common rail injector according to claim 1, wherein said slide pin member is formed as a circular cylindrical pin having a constant diameter, an end of said slide hole leading to said low-pressure side seat is provided with an expanded portion having a greater diameter, an extremity of said slide pin member is located therein, and said throttle portion is formed so as to open to this expanded portion.

8. The common rail injector according to claim 1, wherein at least a sliding surface of said slide pin member is made of a superhard material or a ceramic.

9. The common rail injector according to claim 1, wherein said slide pin member is made of a superhard material having a Young's modulus higher than that of metal.

10. The common rail injector according to claim 1, wherein a valve spring for biasing said valve element toward said low-pressure side seat is arranged on the upstream side of said high-pressure side seat.

11. The common rail injector according to claim 1, wherein $$kpo = 1 - \frac{Ds^2}{Dc^2} - \frac{Fk}{Pc \cdot \frac{\pi}{4} \cdot Dc^2} \geq 0.5$$

when Pc is a maximum supply pressure, kpo is a control chamber pressure ratio at the time of nozzle opening, Ds is a diameter of a nozzle seat for said nozzle needle to sit on, Dc is a control chamber slide diameter, Fk is a nozzle set load, and Pc is a fuel supply pressure from the common rail.

12. The common rail injector according to claim 1, wherein said low-pressure channel and said high-pressure channel are not communicated with each other at a time of seating said valve element against said low-pressure side seat and wherein said low-pressure channel and said high-pressure channel are not communicated with each other at a time of seating said valve element against said high-pressure side seat.

13. The common rail injector according to claim 1, wherein said valve chamber is communicated with said control chamber through a communication channel that has a passage cross sectional area equal to or larger than a passage cross sectional area of said opening, which is surrounded by said low-pressure seat, along an entire extent of said communication channel between said control chamber and said valve chamber.

14. The common rail injector according to claim 1, wherein said control chamber and said high-pressure channel are not communicated with each other at the time of seating said valve element against said high-pressure side seat.

15. A common rail injector for injecting fuel supplied from a common rail through a high-pressure channel, comprising:

a control chamber for applying a pressure in a valve-closing direction to a nozzle needle;

a control valve having a three-way valve structure for switching between communication and interruption of said control chamber with the high-pressure channel and a low-pressure channel, thereby increasing and decreasing the pressure of said control chamber; and a drive unit for driving a valve element of said control valve to selectively set the valve element on a low-pressure side seat, which communicates between said control chamber and said low-pressure channel, or a high-pressure side seat, which communicates between said control chamber and said high-pressure channel, wherein said drive unit has an actuator for causing a displacement when electrically energized, and a slide pin member for sliding inside a slide hole to transmit a driving force in accordance with the displacement of said actuator, said slide pin member having a pin-shaped extremity in contact with said valve element of said control valve accommodated in a valve chamber, a space formed around said pin-shaped extremity disposed between a sliding portion of said slide pin member, which slidably contacts an inner peripheral surface of said slide hole, and said low-pressure side seat is always communicated with said low-pressure channel through a throttle portion, which has a passage cross-sectional area smaller than a passage cross-sectional area of a portion of a portion of an adjacent channel that is located adjacent to said throttle portion on a low-pressure channel side of said throttle portion, and has a longitudinal axis generally parallel to a longitudinal axis of said throttle portion, to communicate between said throttle portion and said low-pressure channel, a slide diameter of said sliding portion of said slide pin member is less than or equal to a diameter of an opening, which is surrounded by said high-pressure seat and is communicated with said high-pressure channel, and the pressure in said control chamber in communication with said valve chamber is exerted as an assistance force for urging said valve element of said control valve against said high-pressure side seat to assist said actuator at a time of driving said valve element of said control valve against said high-pressure side seat.

16. The common rail injector according to claim 15, wherein the pressure in said control chamber in communication with said valve chamber is exerted as an assistance force so that a high-pressure side seat closing load becomes equivalent to or smaller than a low-pressure side seat opening load.

17. The common rail injector according to claim 15, wherein said low-pressure channel and said high-pressure channel are not communicated with each other at a time of seating said valve element against said low-pressure side seat and wherein said low-pressure channel and said high-pressure channel are not communicated with each other at a time of seating said valve element against said high-pressure side seat.

18. The common rail injector according to claim 15, wherein said valve chamber is communicated with said control chamber through a communication channel that has a passage cross sectional area equal to or larger than a passage cross sectional area of said opening, which is surrounded by said low-pressure seat, along an entire extent of said communication channel between said control chamber and said valve chamber.

19. The common rail injector according to claim 15, wherein said control chamber and said high-pressure channel are not communicated with each other at the time of seating said valve element against said high-pressure side seat.

* * * * *